US005483989A

United States Patent [19]

Lim

[11] Patent Number: 5,483,989

[45] Date of Patent: Jan. 16, 1996

[54] APPARATUS FOR DISSOLVING DETERGENT

[75] Inventor: Heetae Lim, Incheon, Rep. of Korea

[73] Assignee: Daewoo Electronics Co., Ltd., Seoul, Rep. of Korea

[21] Appl. No.: 366,118

[22] Filed: Dec. 29, 1994

[30] Foreign Application Priority Data

Mar. 30, 1994 [KR] Rep. of Korea ..... 94-6539

[51] Int. Cl.[6] ..... B01F 3/12

[52] U.S. Cl. ..... 137/268; 422/269

[58] Field of Search ..... 137/268; 422/261, 422/264, 269, 273; 239/310

[56] References Cited

U.S. PATENT DOCUMENTS

| | | | |
|---|---|---|---|
| 820,812 | 5/1906 | Muffly | 422/270 X |
| 1,723,118 | 8/1929 | Anderson | 422/269 |
| 2,793,940 | 5/1957 | Bennett | 137/268 X |
| 3,802,845 | 4/1974 | Tepas, Jr. | 137/268 X |
| 4,336,822 | 6/1982 | Carrell | 137/268 |

*Primary Examiner*—A. Michael Chambers
*Assistant Examiner*—Kevin L. Lee
*Attorney, Agent, or Firm*—Oliff & Berridge

[57] ABSTRACT

Disclosed is a detergent dissolving apparatus which can supply a complete dissolved detergent therewith without any remaining detergent therein. The apparatus has a detergent dissolving container, a detergent introducing container and a rotation device. The detergent dissolving container has a tube disposed on a first sidewall for draining a remaining dissolved detergent. The detergent introducing container has a receiving opening formed at a sidewall thereof for drawing the detergent dissolving container thereinto and thereout, an outlet formed at a lower edge of a side thereof for draining a dissolved detergent, and a water pipe protrudingly formed on one side thereof. The rotation device is rotatably hinged in the detergent dissolving container for promoting dissolving of the detergent. Only the necessary amount of the detergent is used, the overall detergent is not affected by the ejection water so that the solidation thereof is prevented. Therefore, all the detergent which is initially put thereinto is dissolved completely, so that the accurate amount of detergent can be used.

8 Claims, 3 Drawing Sheets

APPARATUS FOR DISSOLVING DETERGENT

BACKGROUND OF THE INVENTION

1. Field of the Invention

The present invention relates to a washing machine having an automatic detergent introducing system and more particularly, to a washing machine to which an automatic detergent introducing system is attached for completely dissolving and introducing detergent into a washing tank.

2. Description of the Prior Arts

A washing machine to which an automatic detergent introducing system is attached has been widely used. There have been general trends wherein automatic systems for introducing the water, detergent and other materials into the washing machine, are attached to almost all kinds of industrial washing machines as well as home-appliance washing machines. Along with these trends, even though various kinds of systems have been proposed, these systems depend on a method wherein a detergent is dissolved previously before being introduced into the washing machine. One example of detergent dissolving apparatus having the above method is disclosed in U.S. Pat. No. 5,007,557 (issued to Cecil B. Young and Lorton).

FIG. 1 is a side view for showing an automatic detergent introducing system as disclosed in the above U.S. patent. The automatic detergent introducing system suggested by Cecil B. Young et al. is a system wherein the amount of detergent to be introduced thereinto is controlled depending on the amount of the spraying water. The automatic detergent introducing system has a container 11 for retaining detergent therein until used, a screen 22 having such a mesh size that only the dissolved portion of the detergent by water can pass through, a nozzle 50 for ejecting water toward screen 22, in a controlled manner to dissolved a portion of the particulate detergent in the vicinity of screen 22 and a funnel tube 24 where the dissolved detergent which passed through screen 22 gathers therein for being dispensed into the interior portion of the washing machine.

An operation of the washing machine will be described below. First, container 11 is filled with the dry particulate detergent which is too large to pass through mesh holes of screen 22 before being dissolved. Once nozzle 50 ejects water which passes through screen 22 to be put into an interior portion of container 11, detergent in the vicinity of the screen is dissolved sufficiently to pass through the screen and gather in a receptacle 24. The water gathered in receptacle 24 can flow through an outlet 48 to be dispensed into the washing tank of the washing machine. The amounts of water ejected from the nozzle can be controlled, so that those of dispensed detergent can be controlled. Thus, if the desired amount of detergent is determined, the ejection amount of water can be controlled by a controller (not shown).

In the above automatic detergent dispensing system, the completely dissolved detergent which can pass through the screen can be put into the washing tank of the washing machine, so that the non-dissolved detergent does not occur in the washing tank of the washing machine. However, the automatic detergent dispensing system according to the above method has various disadvantages, e.g., water is directly ejected toward the container which retains the overall detergent, so that detergent in the middle and upper portions of the container can be wet. The reason is that the particulate detergent can mixed by an intense strength of ejection water, so that the particulate detergent becomes further wet. After finishing an initial cycle of the washing operation, the remaining wet detergent becomes solid, so that, at the next cycle thereof, the amounts of detergent to be dissolved is reduced as compared with the initial use. With that, it is difficult to accurately adjust the desired amount of detergent, and also it takes too much time for the dissolved detergent to pass through the very small mesh hole of the screen. As a result, the washing process is delayed, and so the overall washing time is extended. Further, the dissolved amounts of detergent depend on the strength of ejection water, thereby not to accurately control the dispensed amounts of detergent.

SUMMARY OF THE INVENTION

The present invention is intended to overcome the above-mentioned and numerous other disadvantages and deficiencies of the prior art. Therefore, it is an object of the present invention to provide a detergent dissolving apparatus which can supply a completely dissolved detergent therewith without any remaining detergent therein.

To achieve the above-described object of the present invention, there is provided an apparatus for dissolving detergent which includes:

a detergent dissolving container having a first sidewall and a second sidewall facing the first sidewall, the first sidewall being higher than the second sidewall, and having a tube disposed on the first sidewall for draining a remaining dissolved detergent;

a detergent introducing container having a receiving opening formed at a sidewall thereof for drawing the detergent dissolving container into and out of the detergent introducing container and thereout, an outlet formed at a lower edge of a side thereof for draining a dissolved detergent, and a water pipe protrudingly formed on one side of the detergent introducing container, for supplying water to dissolve the detergent; and a rotation means rotatably hinged on a third sidewall and a fourth sidewall, the fourth sidewall facing the third sidewall, in the detergent dissolving container for promoting dissolving of the detergent.

According to one embodiment of the present invention, the rotation means has two disc-shaped plates, a rotation axis fixed through central portions of the two disc-shaped plates and dissolving wings fixed on the two plates radially centering around the rotation axis. Preferably, a brush is attached to each of the dissolving wings.

According to another embodiment of the present invention, the tube penetrates through the first sidewall of the detergent dissolving container to have an inverted "U" shape and is a siphon tube for draining the remaining dissolved detergent. In such a case, the detergent is introduced into a position close to a sidewall opposite to one sidewall where a siphon tube is disposed.

In the detergent dissolving apparatus according to the present invention, since the necessary amount of the detergent is used, the overall detergent is not affected by the ejection water so that the solidation thereof is prevented. All the detergent which is initially put thereinto is dissolved completely, so that the accurate amount of detergent can be used. Further, the remaining dissolved detergent is completely drained by the siphon tube, so that there is no precipitate any more therein. Water wheel is rotated by the ejecting force of water supplied through the water pipe. Further, the brush attached to the dissolving wing of the dissolving wheel is rotated to completely dissolve the detergent.

BRIEF DESCRIPTION OF THE DRAWINGS

The present invention may be better understood and its numerous objects and advantages will be more apparent to those skilled in the art by reference to the accompanying drawings in which.

DESCRIPTION OF THE PREFERRED EMBODIMENT

The preferred embodiment of the present invention will be described in detail with reference to the accompanying drawings.

Figure 1:
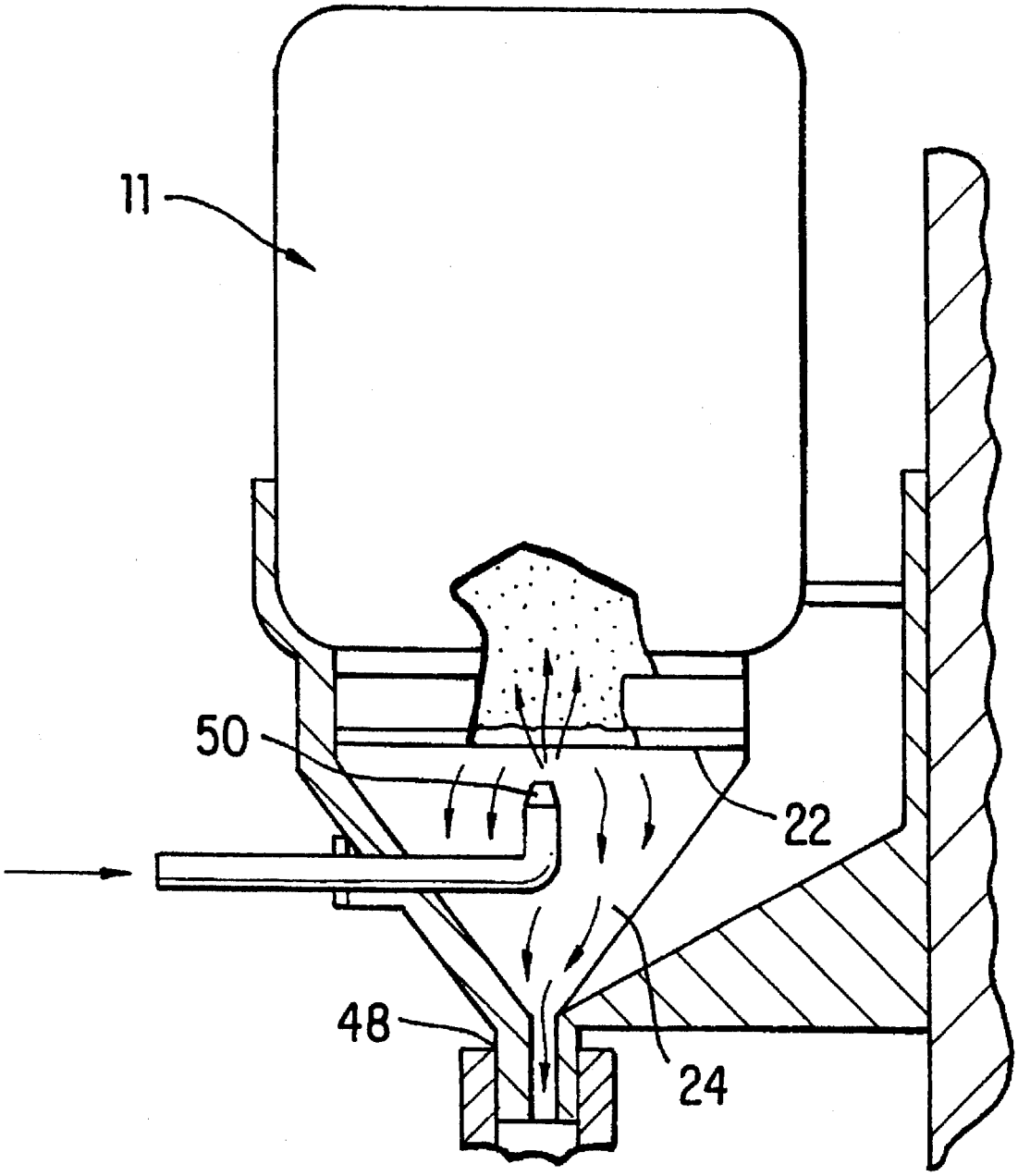
FIG. 1 (PRIOR ART)
FIG. 1 is a side view for showing an automatic detergent introducing system of a conventional washing machine.
Figure 2:
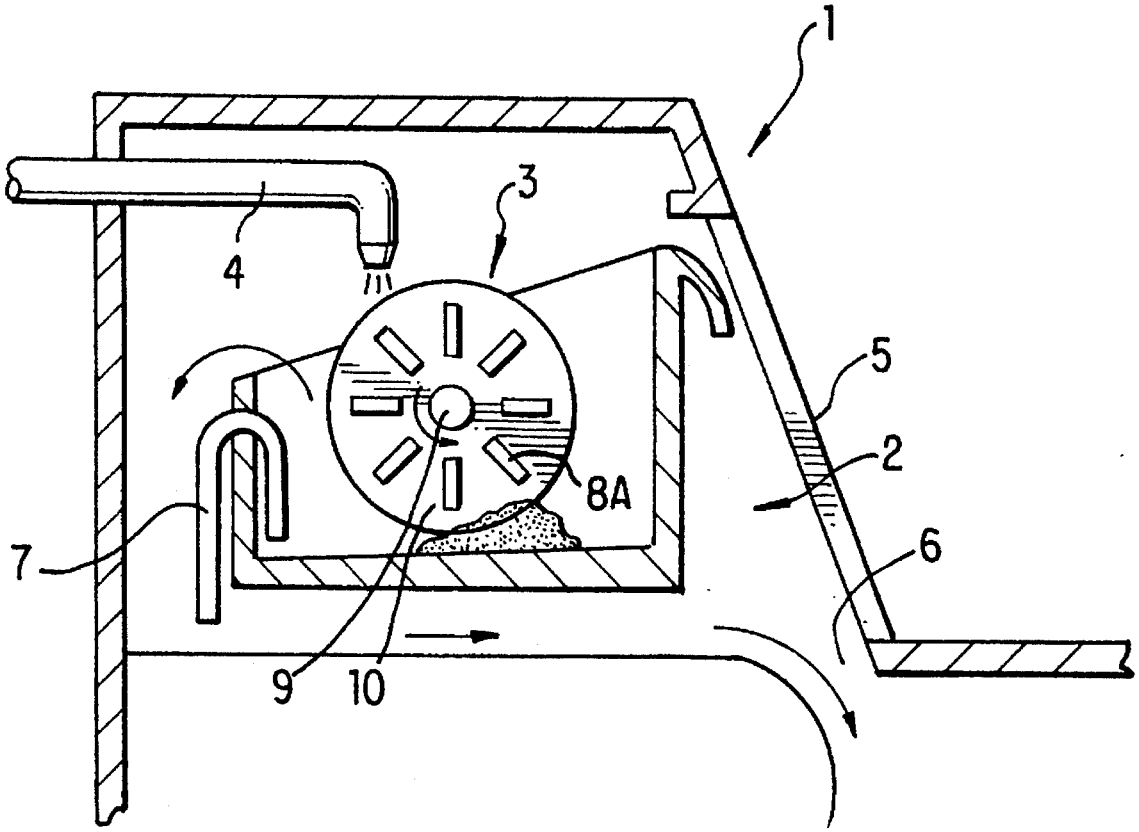
FIG. 2 is a side view for showing a detergent dissolving apparatus according to one embodiment of the present invention.

FIG. 2 is a side view for showing a detergent dissolving apparatus according to one embodiment of the present invention.

The detergent dissolving apparatus of the present invention employs an automatic detergent dispensing system (not shown). First of all, an amount of detergent to be used one time is put into a detergent dissolving container 2 by means of the automatic detergent dispensing system. Detergent dissolving container 2 which retains detergent is received by a detergent introducing container 1 through a receiving opening 5 which is formed on one sidewall thereof. An outlet 6 is provided on one side edge of a lower portion of detergent introducing container 1, so that dissolved detergent can be dispensed into a washing tank of a washing machine (not shown). An upper portion of detergent dissolving container 2 is opened. A first sidewall of container 2 is lower than a second sidewall opposite to the first sidewall. Due to this height difference therebetween, upper edges of a third and a fourth sidewall are lowered in inclined alignment from the first sidewall to the second sidewall. A water wheel 3 (as a rotation device) which is rotatably fixed to inner surfaces of both the third and fourth sidewalls of detergent dissolving container 2. A siphon tube 7 of an inverted "U" shape is formed through an upper portion of the first sidewall.

Figure 3A:
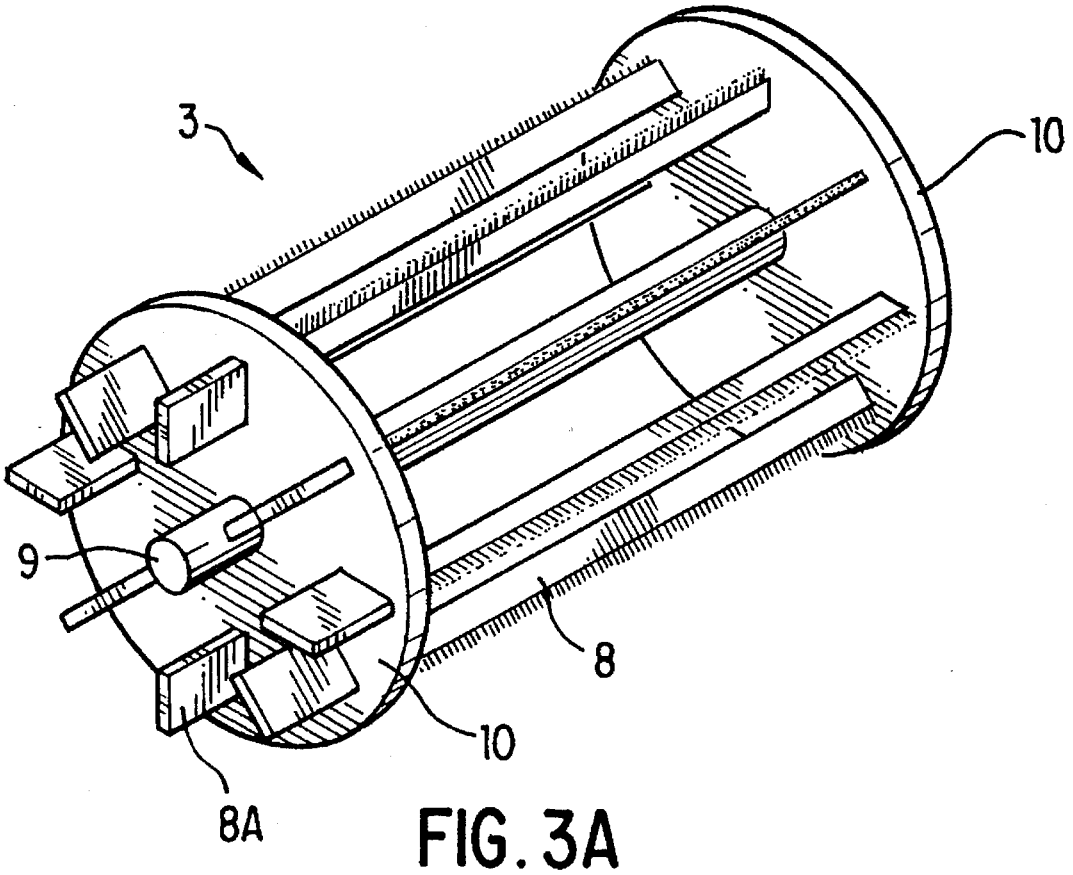
FIG. 3A is a perspective view for showing a water wheel of the detergent dissolving apparatus as shown in FIG. 2.

FIG. 3A is a perspective view for showing the water wheel of the detergent dissolving apparatus. As shown in the figure, water wheel 3 disposed on both the third and fourth sidewalls within detergent dissolving container 2 has two disc-shaped plates 10, a rotation axis 9 which is fixed through each central portion of plates 10 and a plurality of dissolving wings 8 which are fixed on two plates 10 radially centering around rotation axis 9. The shape of water wheel 3 is similar to that of a water mill. Both ends of dissolving wing which preferably penetrate through disc-shaped plates 10 to be protruded to the outside are a rotation wing 8A which is rotated by the ejection water through a water pipe 4.

Figure 3B:
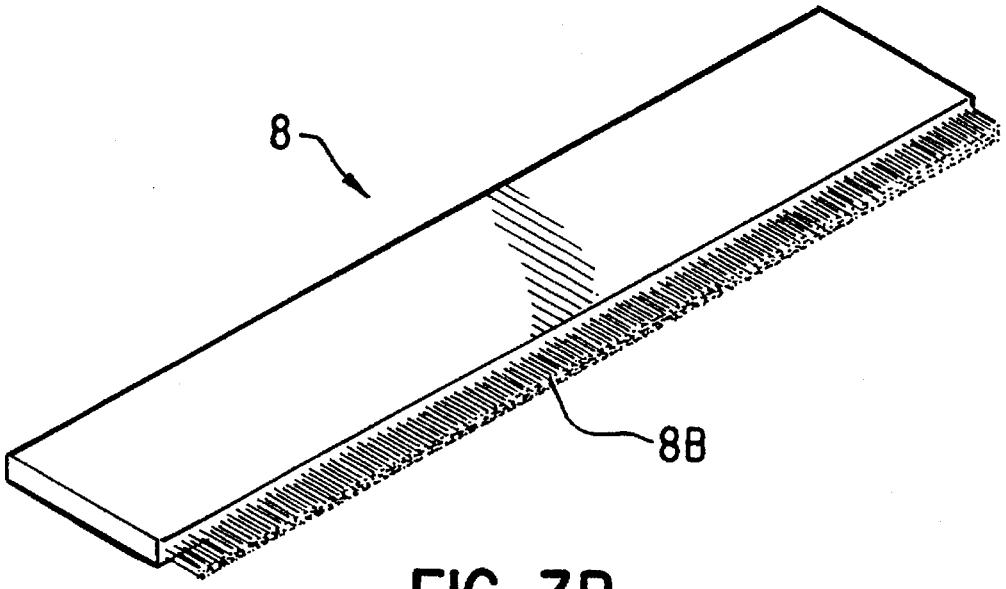
FIG. 3B is a detailed view for a dissolving wing of the water wheel of the detergent dissolving apparatus as shown in FIG. 3A

FIG. 3B is a detailed view for showing the dissolving wing of the water wheel of the detergent dissolving apparatus. As shown in the figure, a brush 8B is attached to one edge of dissolving wing 8 to thereby brush up detergent at the time of rotating the water wheel.

Further, in a siphon tube 7 as shown in FIG. 2, a first tube which is extended downwards to the outside of detergent dissolving container 2 is longer than a second tube which is extended downwards to the inside of detergent dissolving container 2, thereby to obtain an efficient siphon effect. An end of the second tube is formed nearly in contact with a bottom surface of container 2 in order to completely eliminate the remaining dissolved detergent therein.

A water pipe 4 is penetrated through one sidewall of detergent introducing container 1 and bent in a lower direction to directly eject water into water wheel 3 of detergent dissolving container 2. Positions into which a nozzle disposed on an end portion of water pipe 4 ejects water depend on shapes of the water wheel. That is, in case of dissolving wings 8A of which the ends are protruded to the outside thereof, the nozzles is located above rotation wings 8A. To the contrary, without any rotation wing 8A formed of the protruded ends of dissolving wings 8, the nozzles is located directly above dissolving wings 8.

The bottom surface of detergent dissolving container 2 which is close to the first sidewall thereof is a little lower than which is close to the second sidewall to form an inclined bottom surface. The reason is that all of the dissolved detergent should be drained from detergent dissolving container 2 through siphon tube 7.

Hereinafter, an operation of the detergent dissolving system according to the present invention will be described.

Detergent is put into the inside of detergent dissolving container 2 through receiving opening 5 of detergent introducing container 1. At that time, water is ejected on rotation wing 8A through water pipe 4 to rotate water wheel 3. The dissolving wing fixed to water wheel 3 is rotated thereby to mix the ejected water with detergent on the bottom surface of detergent dissolving container 2 and then more rapidly dissolve detergent by water. Subsequently, dissolving wing 8 of water wheel 3 kicks up the dissolved detergent while the amount of the dissolved detergent is heightened by continuous supplement of the water.

When the height of the dissolved detergent has become higher than the first sidewall, the dissolving detergent flows over the first sidewall to the washing tank of the washing machine through outlet 6. The sufficient supply of water therewith stops supplementation of water and then rotation of water wheel 3. At that time, the remaining dissolved detergent in detergent dissolving container 2 is completely drawn out by diphon tube 7, so that there is no remaining dissolved detergent therein.

In order to obtain the sufficient rotating force of water wheel 3, a motor (not shown) is disposed on an outer sidewall of detergent dissolving container 2 rotate rotation axis 9, thereby to obtain the sufficient rotating force. With that, even though a water pressure through the nozzle has become lowered, water wheel 3 can be rotated by the motor, so that it is possible to maintain much higher dissolution degree.

As described above, in the detergent dissolving system according to the present invention, due to the use of only detergent demanded as necessary, the overall detergent does not become solid. All of detergent which was initially put thereinto is dissolved completely, so that the accurate amount of detergent can be used. Further, the remaining detergent is completely drained by the siphon tube, so taht there is no precipitate any more therein. Water is rotated by the ejecting force of water supplied through the water pipe. Futher, the brush attached to the dissolving wing of the dissolving wheel is rotated to completely dissolve the detergent.

In addition, since a predetermined amount of detergent is completely dissolved regardless of the water pressure of the water pipe, the consumption of unnecessary detergent can be prevented. The remaining of undissolved detergent amoung laundry can be prevented to improve the rinsing efficiency.

It is understood that various other modifications will be apparent to and can be readily made by those skilled in the art without departing from the scope and spirit of this invention. Accordingly, it is not intended that the scope of the claims appended thereto be limited to the description as set forth herein, but rather that the claims be constructed as encompassing all the features of the patentable novelty that reside in the present invention, including all the features that would be treated as equivalents thereof by those skilled in the art to which this pertains.

What is claimed is:

1. An apparatus for dissolving a detergent, said apparatus comprising:

a detergent dissolving container having a first sidewall and a second sidewall facing the first sidewall, the first sidewall being higher than the second sidewall, and having a tube disposed on the first sidewall for draining a remaining dissolved detergent;

a detergent introducing container having a receiving opening formed at a sidewall thereof for drawing the detergent dissolving container into and out of said detergent introducing container, an outlet formed at a lower edge of a side thereof for draining a dissolved detergent, and a water pipe protrudingly formed on one side of said detergent introducing container, for supplying water through an outlet of said water pipe to dissolve the detergent; and a rotation means rotatably hinged on a third sidewall and a fourth sidewall, the fourth sidewall facing the third sidewall, for promoting dissolving of the detergent, said rotation means being located in said detergent dissolving container and under the outlet of said water pipe so that the water exited from said outlet of said water pipe rotates said rotation means and the rotation of said rotation means may cause the water from said outlet of said water pipe to mix with the detergent.

2. The apparatus for dissolving a detergent as claimed in claim 1, wherein said rotation means has two disc-shaped plates, a rotation axis fixed through central portions of the two disc-shaped plates and dissolving wings fixed on said two plates radially centering around the rotation axis.

3. The apparatus for dissolving a detergent as claimed in claim 2, said apparatus further comprising a brush attached to each of the dissolving wings.

4. The apparatus for dissolving a detergent as claimed in claim 2, wherein each of the dissolving wings is penetrated through said two disc-shaped plates to be protruded to outside thereof.

5. The apparatus for dissolving a detergent as claimed in claim 1, wherein the tube penetrates through the first sidewall of said detergent dissolving container to have an inverted "U" shape and is a siphon tube for draining the remaining dissolved detergent.

6. The apparatus for dissolving a detergent as claimed in claim 1, wherein a first bottom surface portion near the first sidewall is lower than a second bottom portion near the said second sidewall so that said detergent dissolving container has an inclined bottom.

7. The apparatus for dissolving a detergent as claimed in claim 1, wherein said outlet of said water pipe is a nozzle.

8. An apparatus for dissolving a detergent, said apparatus comprising:

a detergent dissolving container having a first sidewall and a second sidewall facing the first sidewall, the first sidewall being higher than the second sidewall, a first bottom surface portion near the first sidewall being lower than a second bottom portion near said second sidewall so that said detergent dissolving container has an inclined bottom, and having a tube disposed on the first sidewall for draining a remaining dissolved detergent, the tube penetrating through the first sidewall to have an inverted "U" shape and being a siphon tube for drawing the remaining dissolved detergent out of said detergent dissolving container;

a detergent introducing container having a receiving opening formed at a sidewall thereof for drawing the detergent dissolving container into and out of said detergent introducing container, an outlet formed at a lower edge of a side thereof for draining a dissolved detergent, and a water pipe protrudingly formed on one side of said detergent introducing container, for supplying water through an outlet of said water pipe to dissolve the detergent; and rotation means rotatably hinged on a third sidewall and a fourth sidewall, the fourth sidewall facing the third sidewall, for promoting dissolving of the detergent, said rotation means being located in said detergent dissolving container and under the outlet of said water pipe so that water exited from said outlet of said water pipe rotates said rotation means and the rotation of said rotation means causes the water from said outlet of said water pipe to mix with the detergent, said rotation means having two disc-shaped plates, a rotation axis fixed through central portions of the two disc-shaped plates, dissolving wings fixed on said two plates radially centering around the rotation axis and a brush attached to each of the dissolving wings.

* * * * *